US010633825B2

(12) United States Patent
Moriki et al.

(10) Patent No.: US 10,633,825 B2
(45) Date of Patent: Apr. 28, 2020

(54) CONSTRUCTION MACHINE

(71) Applicant: HITACHI CONSTRUCTION MACHINERY CO., LTD., Tokyo (JP)

(72) Inventors: Hidekazu Moriki, Tokyo (JP); Hiroshi Sakamoto, Tsuchiura (JP); Hiroaki Tanaka, Tsuchiura (JP); Yasutaka Tsuruga, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 14 days.

(21) Appl. No.: 16/074,132

(22) PCT Filed: Nov. 17, 2016

(86) PCT No.: PCT/JP2016/084103
§ 371 (c)(1),
(2) Date: Jul. 31, 2018

(87) PCT Pub. No.: WO2017/168822
PCT Pub. Date: Oct. 5, 2017

(65) Prior Publication Data

US 2019/0338494 A1 Nov. 7, 2019

(30) Foreign Application Priority Data

Mar. 31, 2016 (JP) ..... 2016-070130

(51) Int. Cl.
*E02F 9/22* (2006.01)
*E02F 3/43* (2006.01)
(Continued)

(52) U.S. Cl.
CPC ..... *E02F 9/2221* (2013.01); *E02F 3/43* (2013.01); *E02F 9/2267* (2013.01);
(Continued)

(58) Field of Classification Search
CPC ..... E02F 9/2221; E02F 9/2267; E02F 9/22; E02F 3/43; F15B 11/028; F15B 11/08; F15B 11/17; F15B 11/02
See application file for complete search history.

(56) References Cited

U.S. PATENT DOCUMENTS 7,127,887 B2 * 10/2006 Nakamura ..... E02F 9/2228 60/421
7,207,175 B2 * 4/2007 Kim ..... E02F 9/2239 60/422

(Continued)

FOREIGN PATENT DOCUMENTS

JP 07-190009 A 7/1995
JP 09-291560 A 11/1997

(Continued)

OTHER PUBLICATIONS

International Search Report of PCT/JP2016/084103 dated Feb. 21, 2017.
International Preliminary Report on Patentability received in corresponding International Application No. PCT/JP2016/084103 dated Oct. 11, 2018.
Korean Office Action received in corresponding Korean Application No. 10-2018-7014982 dated Sep. 17, 2019.

*Primary Examiner* — Michael J Zanelli
(74) *Attorney, Agent, or Firm* — Mattingly & Malur, PC

(57) ABSTRACT

The construction machine includes: a work implement driven by a first hydraulic actuator and a second hydraulic actuator; a first directional control valve controlling a flow rate and a direction of a hydraulic fluid supplied to the first hydraulic actuator; a first speed-up directional control valve provided in a second pump line and controlling a flow rate and a direction of a hydraulic fluid supplied to the first hydraulic actuator; a second directional control valve controlling a flow rate and a direction of a hydraulic fluid supplied to the second hydraulic actuator; an excavation load sensor that detects an excavation load imposed on the work implement; and a first speed-up control section that drives the first speed-up directional control valve, and the
(Continued)

first speed-up control section is configured to control a driving amount of the first speed-up directional control valve in response to the excavation load.

6 Claims, 11 Drawing Sheets

(51) Int. Cl.
*F15B 11/028* (2006.01)
*F15B 11/044* (2006.01)
*F15B 11/08* (2006.01)
*F15B 11/17* (2006.01)

(52) U.S. Cl.
CPC ..... *F15B 11/028* (2013.01); *F15B 11/044* (2013.01); *F15B 11/08* (2013.01); *F15B 11/17* (2013.01)

(56) References Cited

U.S. PATENT DOCUMENTS

| | | | | |
|---|---|---|---|---|
| 7,895,833 | B2 * | 3/2011 | Kajita | E02F 9/2225 60/424 |
| 9,834,905 | B2 * | 12/2017 | Matsuyama | E02F 3/437 |
| 2016/0040398 | A1 | 2/2016 | Kitajima et al. | |

FOREIGN PATENT DOCUMENTS

| | | | |
|---|---|---|---|
| JP | 10-176347 | A | 6/1998 |
| JP | 2007-100779 | A | 4/2007 |
| JP | 2011-64015 | A | 3/2011 |
| KR | 10-2015-0139541 | A | 12/2015 |

* cited by examiner

PRIOR ART

PRIOR ART

PRIOR ART

CONSTRUCTION MACHINE

TECHNICAL FIELD

The present invention relates to a construction machine.

BACKGROUND ART

Generally, a construction machine includes hydraulic actuators such as hydraulic cylinders that drive a front work device mounted on the construction machine, operation devices operated by an operator, a hydraulic pump, and a control valve that drives internal directional control valves by operation pilot pressures in response to operation amounts of the operation devices and that controls a flow rate and a direction of a hydraulic fluid supplied from the hydraulic pump to each hydraulic actuator.

In addition, the control valve is provided with a relief valve that prevents breakage of hydraulic devices. When the construction machine conducts work such as excavation, a load pressure in response to an excavation reaction force (excavation load) is generated within each of the hydraulic actuators that drive the front work device. The relief valve opens to relieve the hydraulic fluid to a tank when an internal pressure of a hydraulic circuit reaches a predetermined set pressure in such a manner that the internal pressure does not exceed withstanding pressures of the hydraulic devices due to an increase in the load pressure. Energy of the hydraulic fluid relieved from the relief valve is released as heat and, therefore, causes a loss. To address this problem, an ordinary control valve is configured such that directional control valves for different hydraulic actuators are disposed in the same pump line in parallel and a hydraulic fluid is delivered to the actuator at the relatively low load pressure (perform the so-called diversion of the hydraulic fluid) when the internal pressure of the hydraulic circuit increases. It is thereby possible to avoid the loss caused by a relief motion while suppressing an increase in the internal pressure of the hydraulic circuit.

There is known a locus controller for such a construction machine for allowing a tip end of a front work device to converge into a target locus via a satisfactory path that always matches human feeling, irrespective of the operation amount by an operator. (refer to, for example, Patent Document 1). This locus controller computes a position and a posture of the front work device on the basis of signals from angle sensors, and computes a target speed vector of the front work device on the basis of signals from operation lever devices. The locus controller corrects the target speed vector in such a manner that the target speed vector turns toward a point forward in an excavation travel direction by a predetermined distance from a point on the target locus at the shortest distance from the tip end of the front work device, and computes target pilot pressures for driving hydraulic control valves in such a manner that target pilot pressures correspond to the corrected target speed vector. The locus controller controls proportional solenoid valves provided in an operation hydraulic circuit to generate the computed target pilot pressures.

There is also known a controller for a hydraulic construction machine that aims to improve a degree of freedom for matching among actuators that are operated by combined operation and to improve operability of the hydraulic construction machine, and that individually controls opening degrees of a plurality of control valves that control a flow of a hydraulic fluid to one of the actuators (refer to, for example, Patent Document 2). Proportional valves for generating pilot signals are attached to first and second boom control valves that control a flow of a hydraulic fluid to a boom cylinder and to first and second arm control valves that control a flow of a hydraulic fluid to an arm cylinder. This controller determines control signals in response to a boom lever stroke signal and an arm lever stroke signal by using a map set for every work mode, and controls the proportional valves by these control signals.

PRIOR ART DOCUMENT

Patent Document

Patent Document 1: JP-1997-291560-A
Patent Document 2: JP-1995-190009-A

SUMMARY OF THE INVENTION

Problem to be Solved by the Invention

The locus controller for the construction machine described in Patent Document 1 adjusts the opening degrees of the directional control valves disposed in the same pump line in parallel and allows the tip end of the front work device to converge into the target locus by controlling the operation pilot pressures by which the control valves that configure the conventional construction machine are controlled to be driven. Owing to this, when the excavation load increases, then a diversion amount changes to possibly cause the tip end of the front work device to deviate from the target locus, and the convergence of the tip end into the target locus after deviation may be delayed.

Specifically, for example, when the front work device is driven by the boom cylinder and the arm cylinder to conduct excavation (grading work) by leveling and the excavation load is light, a load pressure of the boom cylinder in an extension direction thereof is higher than that of the arm cylinder in the extension direction thereof. Owing to this, it is necessary to set lower the opening degree of the directional control valve for an arm and set higher the opening degree of the directional control valve for a boom. On the other hand, when the excavation load becomes heavy, then the load pressure of the arm cylinder increases in response to a reaction force from an object to be excavated, and the boom is eventually raised upward via the arm that receives the reaction force. As a result, the load pressure of the boom cylinder decreases, the load pressure of the arm cylinder becomes higher than that of the boom cylinder, and the diversion amount to the boom cylinder increases. Consequently, a speed of the arm cylinder decreases, a speed of the boom cylinder increases conversely, and a speed balance is disturbed, possibly causing the tip end of the front work device to deviate from the target locus. Furthermore, the locus controller for the construction machine described above controls the operation pilot pressures in response to the deviation after the tip end of the front work device deviates from the target locus due to the change of the diversion amount. Owing to this, the convergence of the tip end of the front work device into the target locus may be delayed.

To address these problems, if the locus controller for the construction machine described above is combined with the controller for the hydraulic construction machine described in Patent Document 2 and an appropriate work mode is selected, the controller individually controls the opening degrees of the control valves that control the flow of the hydraulic fluid to each of the actuators by a pattern and a lever stroke set for every work mode. It is, therefore, supposed that the operability could improve.

However, the above described load, excavation reaction force, and the like during the excavation work are not taken into account in the map. As a result, when the excavation load increases, it is difficult to suppress the deviation of the tip end of the front work device from the target locus due to the change of the diversion amount and to reduce the delay in the convergence of the tip end into the target locus. It can be supposed, for example, that the operator changes over the work mode in response to the change of the excavation load. In that case, however, a reduction of a work speed and deterioration of efficiency may occur.

The present invention has been achieved on the basis of the circumstances described above. An object of the present invention is to provide a construction machine that can ensure predetermined finishing precision while avoiding a relief-caused loss even if an excavation load increases in leveling work, slope face shaping work, or the like.

Means for Solving the Problem

To solve the problem, the present invention adopts a configuration set forth, for example, in claims. The present application includes a plurality of means for solving the problem. As an example of the means, there is provided a construction machine including: a first hydraulic actuator; a second hydraulic actuator; a work implement driven by the first hydraulic actuator and the second hydraulic actuator; a first hydraulic pump; a second hydraulic pump; a first directional control valve provided in a first pump line that is a delivery hydraulic line of the first hydraulic pump and controlling a flow rate and a direction of a hydraulic fluid supplied to the first hydraulic actuator; a first speed-up directional control valve provided in a second pump line that is a delivery hydraulic line of the second hydraulic pump and controlling a flow rate and a direction of a hydraulic fluid supplied to the first hydraulic actuator; and a second directional control valve provided in the second pump line that is the delivery hydraulic line of the second hydraulic pump and controlling a flow rate and a direction of a hydraulic fluid supplied to the second hydraulic actuator. The construction machine includes: an excavation load sensor that detects an excavation load imposed on the work implement; and a first speed-up control section that drives the first speed-up directional control valve. The first speed-up control section is configured to control a driving amount of the first speed-up directional control valve in response to the excavation load detected by the excavation load sensor.

Effect of the Invention

According to the present invention, the second directional control valve and the first speed-up directional control valve are configured to be able to divert the hydraulic fluid and the driving amount of the first speed-up directional control valve is controlled in response to the excavation load. Therefore, even when the excavation load increases, it is possible to suppress diversion and prevent a deviation from the target locus while avoiding a relief-caused loss. As a consequence, it is possible to ensure predetermined finishing precision.

MODES FOR CARRYING OUT THE INVENTION

Embodiments of a construction machine according to the present invention will be described hereinafter with reference to the drawings.

First Embodiment

Figure 1:
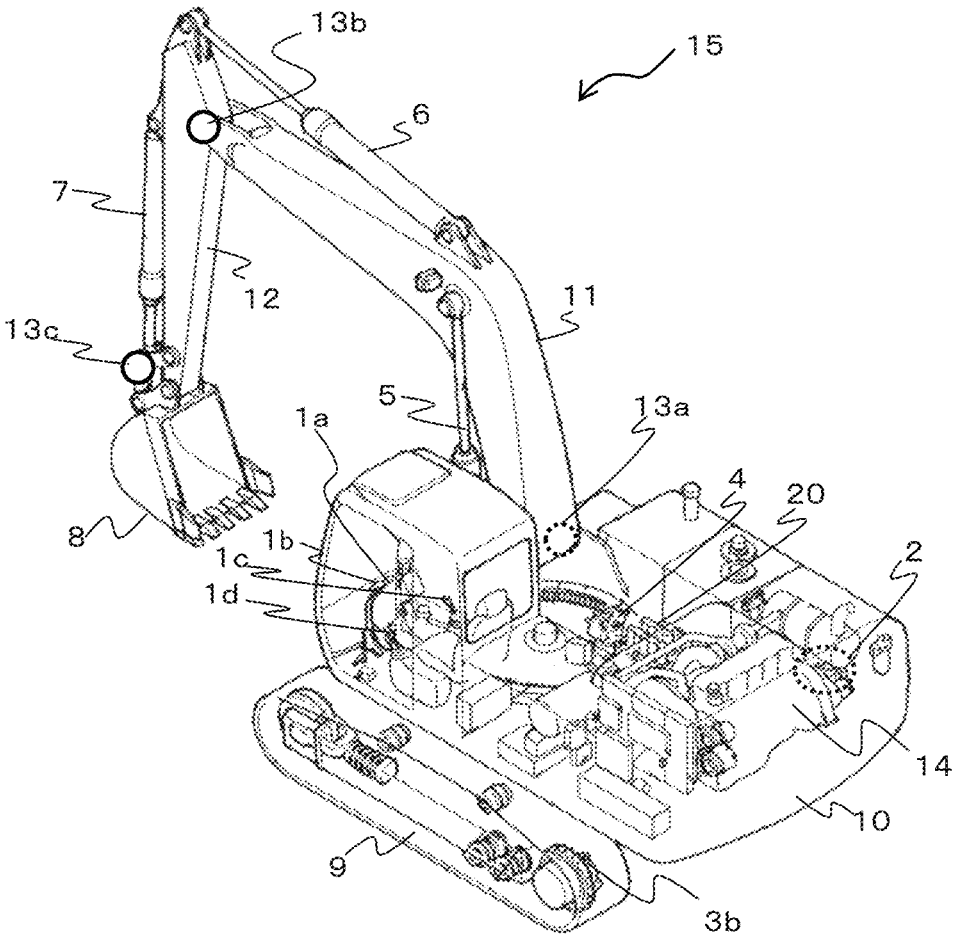
FIG. 1 is a perspective view showing a hydraulic excavator that includes a first embodiment of a construction machine according to the present invention.

FIG. 1 is a perspective view showing a hydraulic excavator that includes a first embodiment of the construction machine according to the present invention. As shown in FIG. 1, the hydraulic excavator includes a lower travel structure 9, an upper swing structure 10, and a work implement 15. The lower travel structure 9 has left and right crawler belt travel devices, which are driven by left and right travel hydraulic motors 3*b* and 3*a* (only the left track hydraulic motor 3*b* is shown). The upper swing structure 10 is swingably mounted on the lower travel structure 9 and driven to swing by a swing hydraulic motor 4. The upper swing structure 10 includes an engine 14 that serves as a prime mover and a hydraulic pump device 2 driven by the engine 14.

The work implement 15 is attached to a front portion of the upper swing structure 10 in such a manner as to be able to be elevated. The upper swing structure 10 is provided with an operation room. Operation devices such as a travel right operation lever device 1*a*, a travel left operation lever device 1*b*, and a right operation lever device 1*c* and a left operation lever device 1*d* for instructing behavior of the work implement 15 and a swing motion are disposed in the operation room.

The work implement 15 has a multijoint structure having a boom 11, an arm 12, and a bucket 8. The boom 11 rotates vertically with respect to the upper swing structure 10 by extension/contraction of a boom cylinder 5, the arm 12 rotates vertically and longitudinally with respect to the boom 11 by extension/contraction of an arm cylinder 6, and the bucket 8 rotates vertically and longitudinally with respect to the arm 12 by extension/contraction of a bucket cylinder 7.

Furthermore, the work implement 15 includes, for calculating a position of the work implement 15, an angle sensor 13*a* that is provided near a coupling portion between the upper swing structure 10 and the boom 11 and that detects an angle of the boom 11, an angle sensor 13*b* that is provided near a coupling portion between the boom 11 and the arm 12 and that detects an angle of the arm 12, and an angle sensor 13*c* that is provided near the arm 12 and the bucket 8 and that detects an angle of the bucket 8. Angle signals detected by these angle sensors 13*a* to 13*c* are inputted to a main controller 100 to be described later.

A control valve 20 controls a flow (a flow rate and a direction) of a hydraulic fluid supplied from the hydraulic pump device 2 to each of hydraulic actuators including the boom cylinder 5, the arm cylinder 6, the bucket cylinder 7, and the left and right travel hydraulic motors 3*b* and 3*a* described above.

Figure 2:
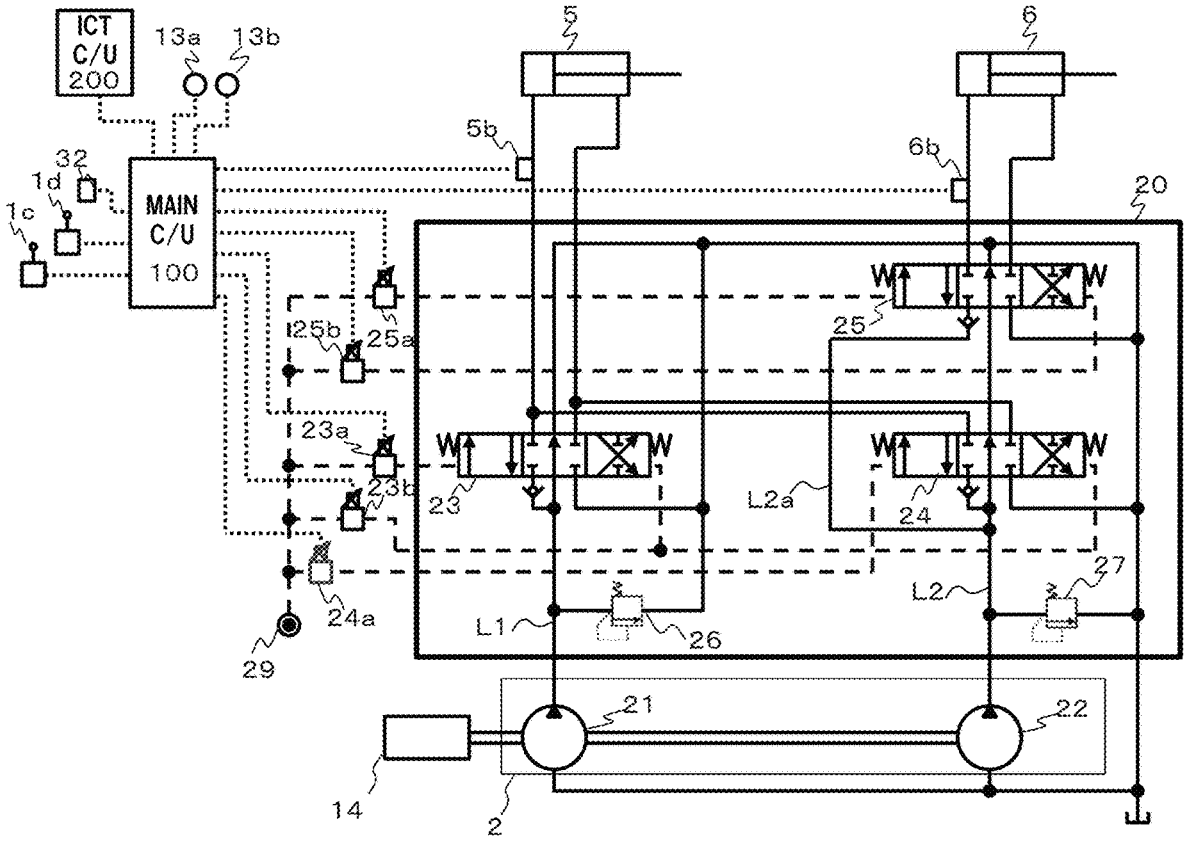
FIG. 2 is a configuration diagram showing a hydraulic drive system for the construction machine including the first embodiment of the construction machine according to the present invention.

FIG. 2 is a configuration diagram showing a hydraulic drive system for the construction machine including the first embodiment of the construction machine according to the present invention. For brevity of description, the hydraulic drive system will be described while assuming that the hydraulic drive system is configured with only the boom cylinder 5 and the arm cylinder 6 as the hydraulic actuators, and a drain circuit and the like that are of no direct relevance to the embodiments of the present invention will not be shown in FIG. 2 and not described. Furthermore, a load check valve and the like similar in configuration and behavior to those provided in a conventional hydraulic drive system will not be described, either.

In FIG. 2, the hydraulic drive system includes the hydraulic pump device 2, the boom cylinder 5 that serves as a first hydraulic actuator, the arm cylinder 6 that serves as a second hydraulic actuator, the right operation lever device 1*c*, the left operation lever device 1*d*, the control valve 20, the main controller 100, and an information controller 200.

The hydraulic pump device 2 includes a first hydraulic pump 21 and a second hydraulic pump 22. The first hydraulic pump 21 and the second hydraulic pump 22 are driven by the engine 14, and deliver hydraulic fluids to a first pump line L1 and a second pump line L2, respectively. While the first hydraulic pump 21 and the second hydraulic pump 22 will be described as fixed displacement hydraulic pumps in the present embodiment, the present invention is not limited to this and the hydraulic pump device 2 may be configured with variable displacement hydraulic pumps.

The control valve 20 is configured with a dual pump line system composed by the first pump line L1 and the second pump line L2. A boom directional control valve 23 that serves as a first directional control valve is connected to the first pump line L1, and the hydraulic fluid delivered by the first hydraulic pump 21 is supplied to the boom cylinder 5. Likewise, a boom speed-up directional control valve 24 that serves as a first speed-up directional control valve and an arm directional control valve 25 that serves as a second directional control valve are connected to the second pump line L2, and the hydraulic fluid delivered by the second hydraulic pump 22 is supplied to the boom cylinder 5 and the arm cylinder 6. It is noted that the boom speed-up directional control valve 24 and the arm directional control valve 25 are configured to be able to divert the hydraulic fluid by a parallel circuit L2*a*.

The first pump line L1 and the second pump line L2 are individually provided with relief valves 26 and 27, respectively. When a pressure of each of the pump lines reaches a preset relief pressure, the relief valve 26 or 27 opens to relieve the hydraulic fluid to a tank.

The boom directional control valve 23 is driven to move by a pilot hydraulic fluid supplied to a pressure receiving section via solenoid proportional valves 23*a* and 23*b*. Likewise, the boom speed-up directional control valve 24 moves by supplying a pilot hydraulic fluid to a pressure receiving section of the boom speed-up directional control valve 24 via solenoid proportional valves 24*a* and 23*b* (note that the solenoid proportional valve 23*b* is also used for moving the boom directional control valve 23), and the arm directional control valve 25 moves by supplying a pilot hydraulic fluid to a pressure receiving section of the arm directional control valve 25 via solenoid proportional valves 25*a* and 25*b*.

These solenoid proportional valves 23*a*, 23*b*, 24*a*, 25*a*, and 25*b* each output a secondary pilot hydraulic fluid, which is obtained by reducing a pressure of the pilot hydraulic fluid supplied from a pilot hydraulic fluid source 29 as an original pressure at a pressure in response to a command current from the main controller 100, to the directional control valves 23 to 25.

The right operation lever device 1*c* outputs, as a boom operation signal, a voltage signal in response to an operation amount and an operation direction of an operation lever to the main controller 100. Likewise, the left operation lever device 1*d* outputs, as an arm operation signal, a voltage signal in response to an operation amount and an operation direction of an operation lever to the main controller 100.

The boom cylinder 5 is provided with a boom cylinder bottom-chamber-side pressure sensor 5*b* that detects a pressure of a bottom-side hydraulic chamber, and the arm cylinder 6 is provided with an arm cylinder bottom-chamber-side pressure sensor 6*b* that detects a pressure of a bottom-side hydraulic chamber and that serve as an excavation load sensor as in claims. The boom cylinder bottom-chamber-side pressure sensor 5*b* and the arm cylinder bottom-chamber-side pressure sensor 6*b* each output a detected pressure signal to the main controller 100.

A mode setting switch 32 is disposed within the operation room, and enables an operator to select whether to enable or disable semiautomatic control in work conducted by the construction machine. That is, either True: the semiautomatic control enabled or False: the semiautomatic control disabled can be selected.

The main controller 100 inputs a semiautomatic control enable flag transmitted from the mode setting switch 32, target surface information transmitted from the information controller 200, the boom angle signal and the arm angle signal transmitted from the angle sensors 13*a* and 13*b*, respectively, and the boom bottom pressure signal and the arm bottom pressure signal transmitted from the boom cylinder bottom-chamber-side pressure sensor 5*b* and the arm cylinder bottom-chamber-side pressure sensor 6*b*, respectively. The main controller 100 outputs command signals to the solenoid proportional valves 23*a*, 23*b*, 24*a*, 25*a*, and 25*b* for driving them respectively in response to these input signals. It is noted that computing performed by the information controller 200 is of no direct relevance to the present invention; thus, a description thereof will be omitted.

Figure 3:
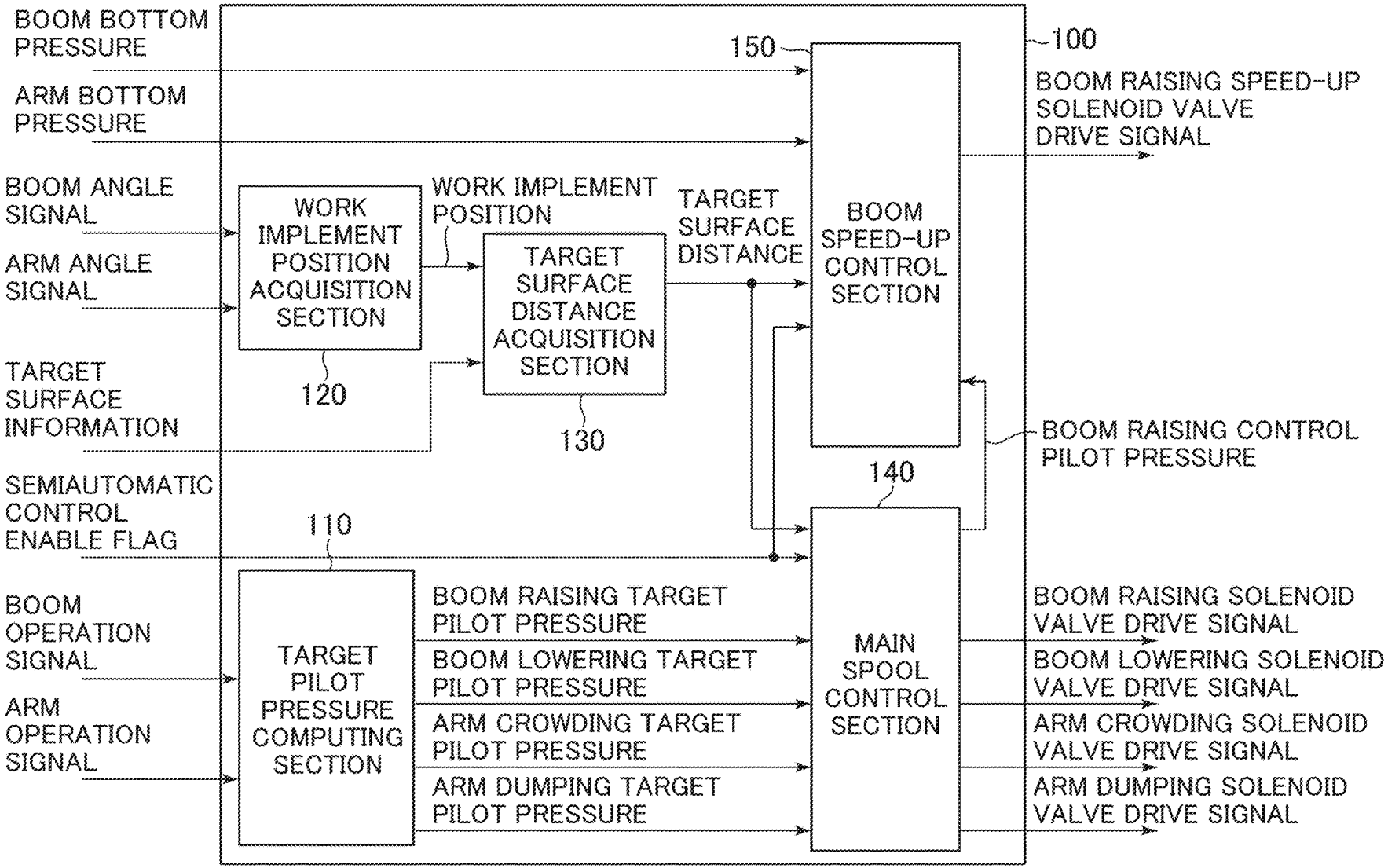
FIG. 3 is a conceptual diagram showing a configuration of a main controller that configures the first embodiment of the construction machine according to the present invention.
Figure 4:
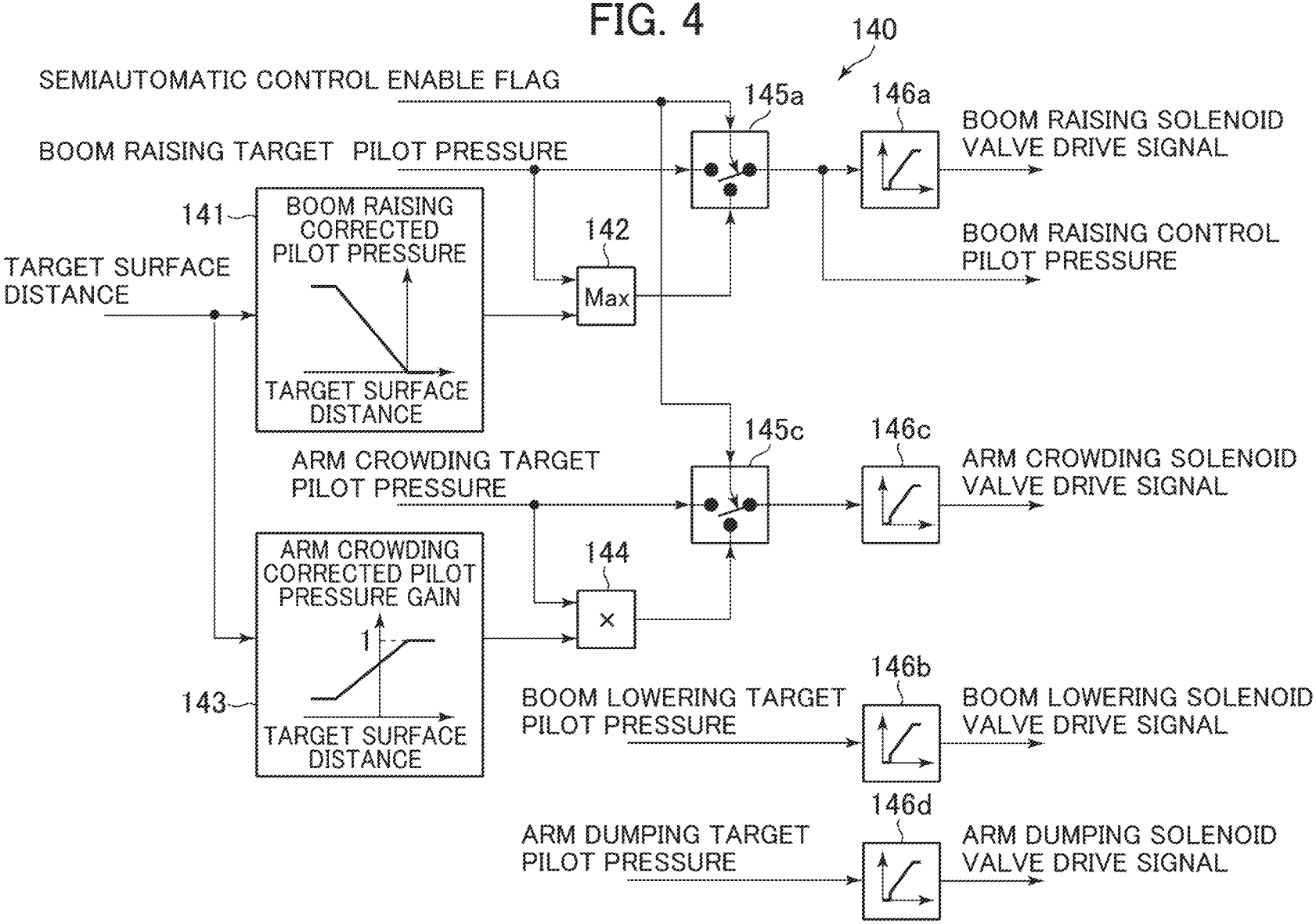
FIG. 4 is a control block diagram showing an example of computing contents of a main spool control section in the main controller that configures the first embodiment of the construction machine according to the present invention.
Figure 5:
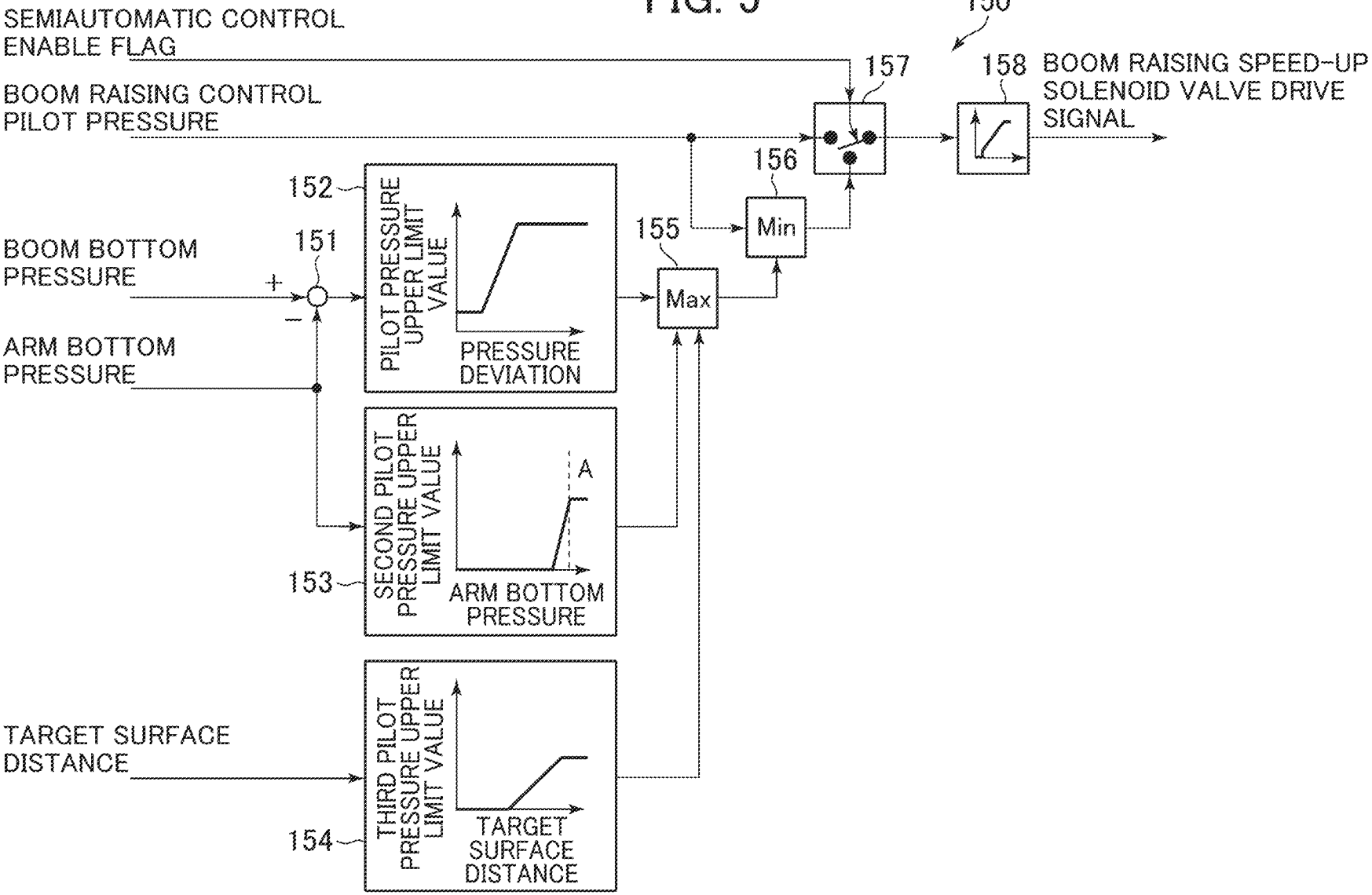
FIG. 5 is a control block diagram showing an example of computing contents of a boom speed-up control section in the main controller that configures the first embodiment of the construction machine according to the present invention.

Next, the main controller 100 that configures the first embodiment of the construction machine according to the present invention will be described with reference to the drawings. FIG. 3 is a conceptual diagram showing a configuration of the main controller that configures the first embodiment of the construction machine according to the present invention. FIG. 4 is a control block diagram showing an example of computing contents of a main spool control section in the main controller that configures the first embodiment of the construction machine according to the present invention. FIG. 5 is a control block diagram showing an example of computing contents of a boom speed-up control section in the main controller that configures the first embodiment of the construction machine according to the present invention.

As shown in FIG. 3, the main controller 100 includes a target pilot pressure computing section 110, a work implement position acquisition section 120, a target surface distance acquisition section 130, a main spool control section 140, and a boom speed-up control section 150.

The target pilot pressure computing section 110 input the boom operation amount signal from the right operation lever device 1*c* and the arm operation amount signal from the left operation lever device 1*d*. The target pilot pressure computing section 110 computes a boom raising target pilot pressure, a boom lowering target pilot pressure, an arm crowding target pilot pressure, and an arm dumping target pilot pressure in response to the input signals, and outputs the computed pressures to the main spool control section 140. It is noted that the boom raising target pilot pressure is set higher as a boom operation amount is larger in a boom raising direction, and that the boom lowering target pilot pressure is set higher as the boom operation amount is larger in a boom lowering direction. Likewise, the arm crowding target pilot pressure is set higher as an arm operation amount is larger in an arm crowding direction, and that the arm dumping target pilot pressure is set higher as the arm operation amount is larger in an arm dumping direction.

The work implement position acquisition section 120 inputs the boom angle signal and the arm angle signal from the angle sensors 13*a* and 13*b*, computes a tip end position of the bucket 8 in response to the input signals by using preset geometric information on the boom 11 and the arm 12, and outputs the computed tip end position, as a work implement position signal, to the target surface distance acquisition section 130. It is noted that the work implement position is computed as, for example, one point on a coordinate system fixed to the construction machine. However, the work implement position is not limited to this but may be computed as a plurality of point groups taking into account the shape of the work implement 15. Alternatively, the work implement position acquisition section 120 may perform computing similar to that performed by the locus controller for the construction machine described in Patent Document 1.

The target surface distance acquisition section 130 inputs the target surface information transmitted from the information controller 200 and the work implement position signal from the work implement position acquisition section 120, computes a distance between the work implement 15 and a construction target surface (hereinafter, referred to as target surface distance), and outputs the target surface distance to the main spool control section 140 and the boom speed-up control section 150. It is noted that the target surface information is given as, for example, two points on a two-dimensional plane coordinate system fixed to the construction machine. However, the target surface information is not limited to this but may be given as three points that configure a plane on a global three-dimensional coordinate system. In the latter case, however, it is required to perform coordinate transformation from the three-dimensional coordinate system into a coordinate system same as that on which the work implement position is defined. Furthermore, when computing the work implement position as the point groups, the target surface distance acquisition section 130 may compute the target surface distance using a point closest to the target surface information. Alternatively, the target surface distance acquisition section 130 may perform computing similar to that performed by the locus controller for the construction machine described in Patent Document 1 to compute a shortest distance $\Delta h$.

The main spool control section 140 inputs the semiautomatic control enable flag transmitted from the mode setting switch 32, the boom raising target pilot pressure, the boom lowering target pilot pressure, the arm crowding target pilot pressure, and the arm dumping target pilot pressure from the target pilot pressure computing section 110, and a target surface distance signal from the target surface distance acquisition section 130. When the semiautomatic control enable flag is True, the main spool control section 140 performs computing to correct the target pilot pressures in response to the target surface distance, computes a boom raising solenoid valve drive signal, a boom lowering solenoid valve drive signal, an arm crowding solenoid valve drive signal, and an arm dumping solenoid valve drive signal, and outputs these signals as drive signals for driving the solenoid proportional valves 23*a*, 23*b*, 25*a*, and 25*b* corresponding to the drive signals. Details of the computing performed by the main spool control section 140 will be described later.

The boom speed-up control section 150 inputs the semiautomatic control enable flag transmitted from the mode setting switch 32, a boom raising control pilot pressure from the main spool control section 140, the target surface distance signal from the target surface distance acquisition section 130, the boom cylinder bottom-side hydraulic chamber pressure signal (hereinafter, also referred to as boom bottom pressure signal) and the arm cylinder bottom-side hydraulic chamber pressure signal (hereinafter, also referred to as arm bottom pressure signal) transmitted from the pressure sensors 5*b* and 6*b*, respectively. The boom speed-up control section 150 performs computing to correct the boom raising target pilot pressure, computes a boom raising speed-up solenoid valve drive signal, and outputs the drive signal as a drive signal for driving the solenoid proportional valve 24*a*. Details of the computing performed by the boom speed-up control section 150 will be described later.

An example of the computing performed by the main spool control section 140 will be described with reference to FIG. 4. The main spool control section 140 includes a boom raising corrected pilot pressure table 141, a maximum value selector 142, an arm crowding corrected pilot pressure gain table 143, a multiplier 144, selectors 145*a* and 145*c*, and solenoid valve drive signal tables 146*a*, 146*b*, 146*c*, and 146*d*.

The boom raising corrected pilot pressure table 141 inputs the target surface distance signal, computes a boom raising corrected pilot pressure using a preset table, and outputs the boom raising corrected pilot pressure to the maximum value selector 142. The maximum value selector 142 inputs the boom raising target pilot pressure and the boom raising corrected pilot pressure, selects a maximum value between the boom raising target pilot pressure and the boom raising corrected pilot pressure, and outputs the maximum value to a second input terminal of the selector 145*a*. The boom raising corrected pilot pressure table 141 is set such that the boom raising corrected pilot pressure becomes higher as the target surface distance becomes larger in a negative direction, that is, as the work implement 15 gets deeper into the target surface. It is thereby possible to perform a boom raising motion in response to the target surface distance and prevent the work implement 15 from getting into the target surface.

The selector 145*a* inputs the boom raising target pilot pressure signal through a first input terminal thereof, an output signal from the maximum value selector 142 described above through the second input terminal, and a semiautomatic control enable flag signal through a switched input terminal thereof. The selector 145*a* selects and outputs the boom raising target pilot pressure signal when the semiautomatic control enable flag signal is False, and selects and outputs the maximum value between the boom raising target pilot pressure signal and the boom raising corrected pilot pressure signal when the semiautomatic control enable flag signal is True. An output signal from the selector 145*a* is outputted, as a boom raising control pilot pressure signal, to the solenoid valve drive signal table 146*a* and the boom speed-up control section 150.

The solenoid valve drive signal table 146*a* computes and outputs the solenoid valve drive signal in response to the input boom raising control pilot pressure signal by using a preset table to drive the solenoid proportional valve 23*a*. Likewise, the solenoid valve drive signal table 146*b* computes and outputs the solenoid valve drive signal in response to the input boom raising/lowering target pilot pressure signal by using a preset table to drive the solenoid proportional valve 23*b*.

The arm crowding corrected pilot pressure gain table 143 inputs the target surface distance signal, computes an arm crowding corrected pilot pressure gain in response to the target surface distance by using a preset table, and outputs the arm crowding corrected pilot pressure gain to the multiplier 144. The multiplier 144 inputs the arm crowding target pilot pressure and the arm crowding corrected pilot pressure gain, multiplies the input arm crowding target pilot pressure by the input arm crowding corrected pilot pressure gain, and outputs a multiplication result to a second input terminal of the selector 145*c*. The arm crowding corrected pilot pressure gain table 143 is set such that the arm crowding corrected pilot pressure becomes lower as the target surface distance becomes larger in the negative direction, that is, as the work implement 15 gets deeper into the target surface. It is thereby possible to reduce an arm crowding speed in response to the target surface distance and prevent the work implement 15 from getting into the target surface.

The selector 145*c* inputs the arm crowding target pilot pressure signal through a first input terminal thereof, an output signal from the multiplier 144 described above through the second input terminal, and the semiautomatic control enable flag signal through a switched input terminal thereof. The selector 145*c* selects and outputs the arm crowding target pilot pressure signal when the semiautomatic control enable flag signal is False, and selects and outputs an arm crowding corrected pilot pressure signal obtained by multiplying the arm crowding target pilot pressure signal by the arm crowding corrected pilot pressure gain when the semiautomatic control enable flag signal is True. An output signal from the selector 145*c* is outputted, as the arm crowding control pilot pressure signal, to the solenoid valve drive signal table 146*c*.

The solenoid valve drive signal table 146*c* computes and outputs the solenoid valve drive signal in response to the input arm crowding control pilot pressure signal by using a preset table to drive the solenoid proportional valve 25*a*. Likewise, the solenoid valve drive signal table 146*d* computes and outputs the solenoid valve drive signal in response to the input arm dumping target pilot pressure signal by using a preset table to drive the solenoid proportional valve 25*b*.

It is noted that the boom raising target pilot pressure and the arm crowding target pilot pressure may be corrected by vector direction correction described in Patent Document 1.

Next, an example of the computing performed by the boom speed-up control section 150 will be described with reference to FIG. 5. The boom speed-up control section 150 includes a subtracter 151, a pilot pressure upper limit value table 152, a second pilot pressure upper limit value table 153, a third pilot pressure upper limit value table 154, a maximum value selector 155, a minimum value selector 156, a selector 157, and a solenoid valve drive signal table 158.

The subtracter 151 inputs the boom bottom pressure signal and the arm bottom pressure signal, computes a pressure deviation by subtracting the arm bottom pressure signal from the boom bottom pressure signal, and outputs the pressure deviation to the pilot pressure upper limit value table 152. It is noted that the pressure deviation getting smaller indicates an increase of an arm bottom pressure relative to a boom bottom pressure, which in turn indicates an increase of an excavation load imposed on the work implement 15. The pilot pressure upper limit value table 152 computes a pilot pressure upper limit value in response to the input pressure deviation by using a preset table, and outputs the pilot pressure upper limit value to the maximum value selector 155.

The pilot pressure upper limit value table 152 is set such that the pilot pressure upper limit value becomes lower as the pressure deviation between the boom bottom pressure signal and the arm bottom pressure signal becomes smaller, that is, the excavation load imposed on the work implement 15 becomes heavier. Thus, when the excavation load increases, it is detected that the arm bottom pressure increases and the deviation between the arm bottom pressure and the boom bottom pressure becomes smaller, and a boom raising speed-up pilot pressure delivered by the solenoid proportional valve 24*a* is suppressed to limit a meter-in opening of the boom speed-up directional control valve 24. As a result, diversion of the hydraulic fluid from the second hydraulic pump 22 to the boom cylinder 5 is suppressed and a speed balance is kept between the arm cylinder 6 and the boom cylinder 5; thus, it is possible to attain predetermined finishing precision.

The second pilot pressure upper limit value table 153 computes a second pilot pressure upper limit value in response to the input arm bottom pressure signal by using a preset table, and outputs the second pilot pressure upper limit value to the maximum value selector 155. The second pilot pressure upper limit value table 153 is set such that the second pilot pressure upper limit value becomes higher as the arm bottom pressure signal becomes higher. It is noted that the arm bottom pressure indicated by a dotted line A in FIG. 5 is approximately identical to the relief pressure and that the second pilot pressure upper limit value is raised up to a maximum value before the arm bottom pressure becomes approximately identical to the relief pressure. Thus, it is detected that the arm bottom pressure increases to be closer to the relief pressure, and the boom raising speed-up pilot pressure delivered by the solenoid proportional valve 24*a* is increased to enlarge the meter-in opening of the boom speed-up directional control valve 24. It is, therefore, possible to divert the hydraulic fluid from the second hydraulic pump 22 to the boom cylinder 5 and avoid a relief-caused loss. When the arm bottom pressure increases and the deviation between the arm bottom pressure and the boom bottom pressure becomes smaller as described above, the meter-in opening of the boom speed-up directional control valve 24 is limited to keep the speed balance between the arm cylinder 6 and the boom cylinder 5. When the arm bottom pressure becomes excessively high after limiting the meter-in opening, the meter-in opening of the boom speed-up directional control valve 24 is enlarged. As a result, even when the arm bottom pressure increases and the deviation becomes smaller, it is possible to avoid the relief-caused pressure loss while keeping the speed balance between the boom and the arm.

The third pilot pressure upper limit value table 154 inputs the target surface distance signal, computes a third pilot pressure upper limit value using a preset table, and outputs the third pilot pressure upper limit value to the maximum value selector 155. The third pilot pressure upper limit value table 154 is set such that the second pilot pressure upper limit value becomes higher as the target surface distance becomes larger. This setting makes it possible to ensure the diversion of the hydraulic fluid from the second hydraulic pump 22 to the boom cylinder 5 and avoid the relief-caused loss when the work implement 15 is at a distant position from the target surface.

The maximum value selector 155 inputs the pilot pressure upper limit value, the second pilot pressure upper limit value, and the third pilot pressure upper limit value, corrects the pilot pressure upper limit value by selecting a maximum value among the pilot pressure upper limit value, the second pilot pressure upper limit value, and the third pilot pressure upper limit value, and outputs the corrected pilot pressure upper limit value to the minimum value selector 156.

The minimum value selector 156 inputs the boom raising control pilot pressure generated by operator's lever operation and the pilot pressure upper limit value from the maximum value selector 155, corrects the boom raising control pilot pressure by selecting a minimum value between the boom raising control pilot pressure and the pilot pressure upper limit value, and outputs the corrected boom raising control pilot pressure to a second input terminal of the selector 157.

The selector 157 inputs the boom raising control pilot pressure signal through a first input terminal thereof, an output signal from the minimum value selector 156 described above through the second input terminal, and the semiautomatic control enable flag signal through a switched input terminal thereof. The selector 157 selects and outputs the boom raising control pilot pressure signal when the semiautomatic control enable flag signal is False, and selects and outputs a value obtained by correcting the boom raising control pilot pressure in response to the boom bottom pressure, the arm bottom pressure, and the target surface distance when the semiautomatic control enable flag signal is True. An output signal from the selector 157 is outputted to the solenoid valve drive signal table 158.

The solenoid valve drive signal table 158 computes and outputs the boom raising speed-up solenoid valve drive signal in response to the boom raising control pilot pressure by using a preset table to drive the solenoid proportional valve 24*a*.

Figure 6:
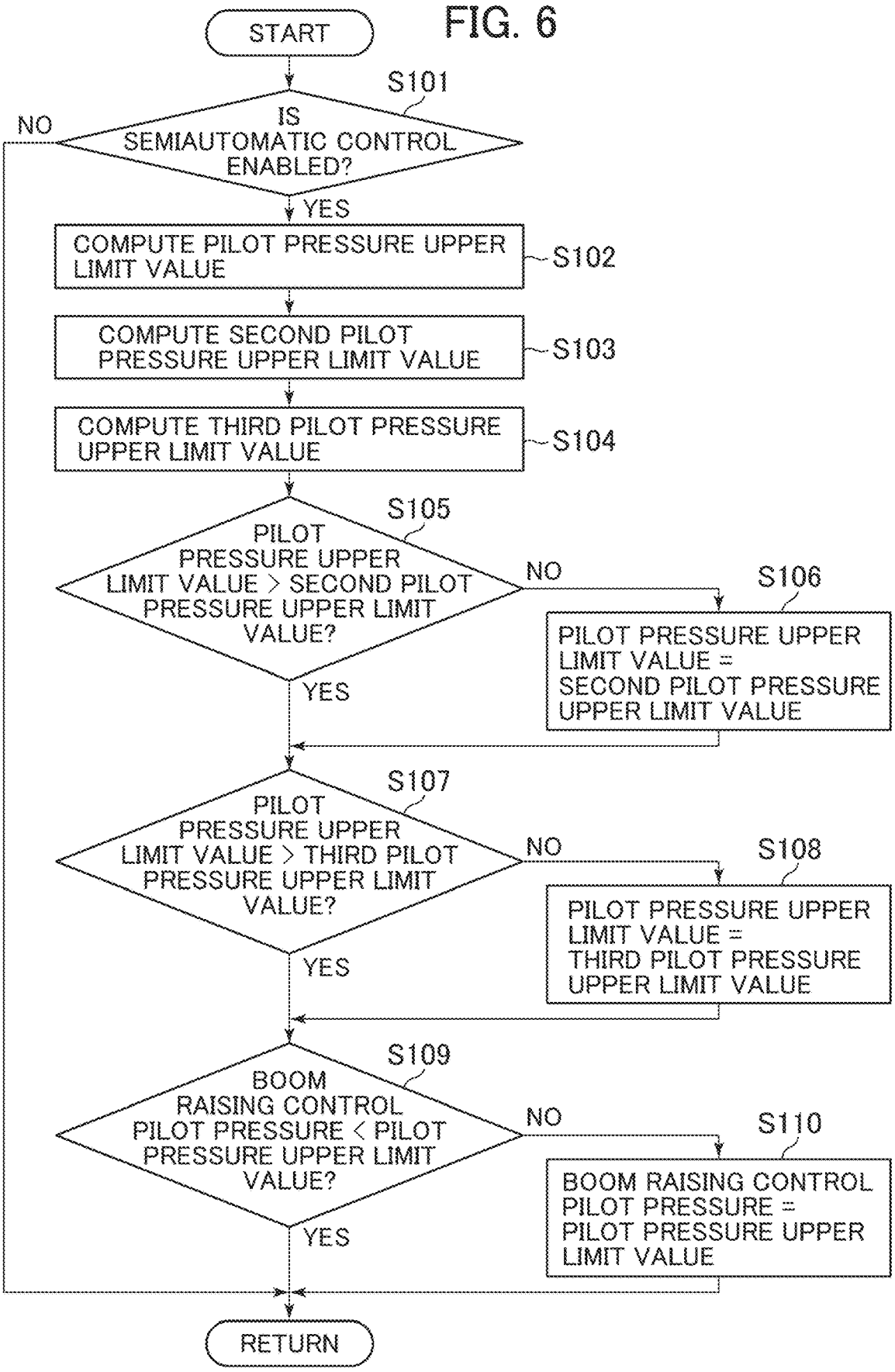
FIG. 6 is a flowchart showing an example of a flow of computing by the boom speed-up control section in the main controller that configures the first embodiment of the construction machine according to the present invention.

Next, a computing flow of the boom speed-up control section 150 will be described with reference to FIG. 6. FIG. 6 is a flowchart showing an example of a flow of computing by the boom speed-up control section in the main controller that configures the first embodiment of the construction machine according to the present invention.

The boom speed-up control section 150 in the main controller 100 determines whether the semiautomatic control is enabled or disabled (Step S101). Specifically, the boom speed-up control section 150 determines whether the semiautomatic control enable flag signal is True or False. When the semiautomatic control enable flag signal is True, the flow goes to (Step S102); otherwise, the flow goes to RETURN.

The boom speed-up control section 150 computes the pilot pressure upper limit value, the second pilot pressure upper limit value, and the third pilot pressure upper limit value (Steps S102, S103, and S104). Specifically, the pilot pressure upper limit value table 152, the second pilot pressure upper limit value table 153, and the third pilot pressure upper limit value table 154 execute the computing.

The boom speed-up control section 150 determines whether the pilot pressure upper limit value exceeds the second pilot pressure upper limit value or not (Step S105). When the pilot pressure upper limit value exceeds the second pilot pressure upper limit value, the flow goes to (Step S107); otherwise, the flow goes to (Step S106).

When the pilot pressure upper limit value does not exceed the second pilot pressure upper limit value in (Step S105), the boom speed-up control section 150 sets the pilot pressure upper limit value to the second pilot pressure upper limit value (Step S106). The flow then goes to (Step S107).

The boom speed-up control section 150 determines whether the pilot pressure upper limit value exceeds the third pilot pressure upper limit value (Step S107). When the pilot pressure upper limit value exceeds the third pilot pressure upper limit value, the flow goes to (Step S109); otherwise, the flow goes to (Step S108).

When the pilot pressure upper limit value does not exceed the third pilot pressure upper limit value in (Step S107), the boom speed-up control section 150 sets the pilot pressure upper limit value to the third pilot pressure upper limit value (Step S108). The flow then goes to (Step S109).

The boom speed-up control section 150 determines whether the boom raising control pilot pressure is lower than the pilot pressure upper limit value (Step S109). When the boom raising control pilot pressure is lower than the pilot pressure upper limit value, the flow goes to RETURN and the boom raising speed-up solenoid valve 24*a* is controlled in response to the boom raising control pilot pressure. In this case, controlling a driving amount of the boom speed-up directional control valve 24 depending on the excavation load or the like, which is characteristic of the present invention, is not executed. When the boom raising control pilot pressure is not lower than the pilot pressure upper limit value, the flow goes to (Step S110).

When the boom raising control pilot pressure is not lower than the pilot pressure upper limit value in (Step S109), the boom speed-up control section 150 sets the boom raising control pilot pressure to the pilot pressure upper limit value (Step S110). Specifically, the boom raising speed-up solenoid valve 24*a* is controlled in response to the pilot pressure upper limit value. As a result, the controlling the driving amount of the boom speed-up directional control valve 24 depending on the excavation load or the like is executed; thus, it is possible to suppress the diversion and prevent the deviation from the target locus while avoiding the relief-caused loss even when the excavation load increases.

Figure 7A:
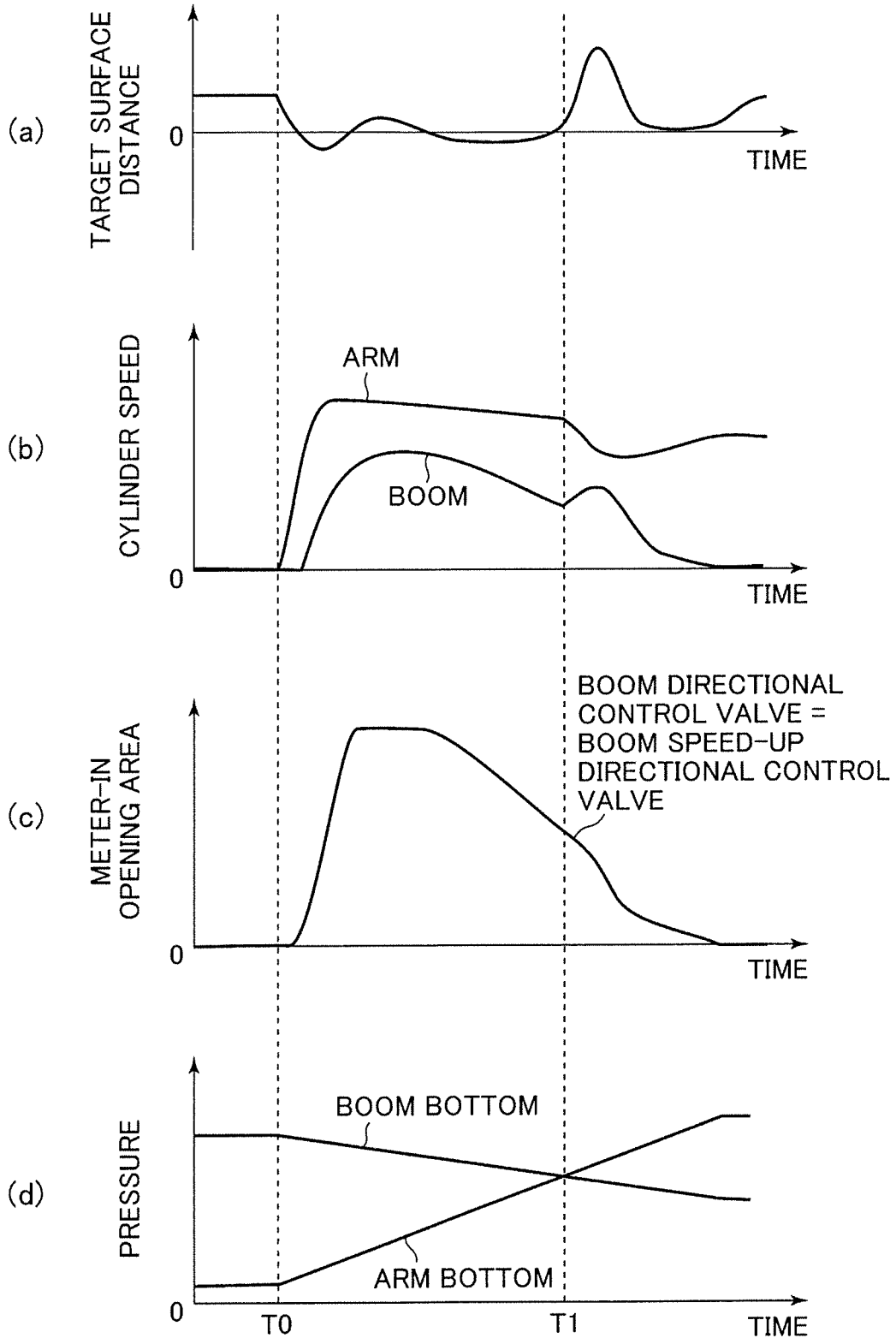
FIG. 7A is a characteristic diagram showing an example of time-series behavior of a conventional construction machine.
Figure 7B:
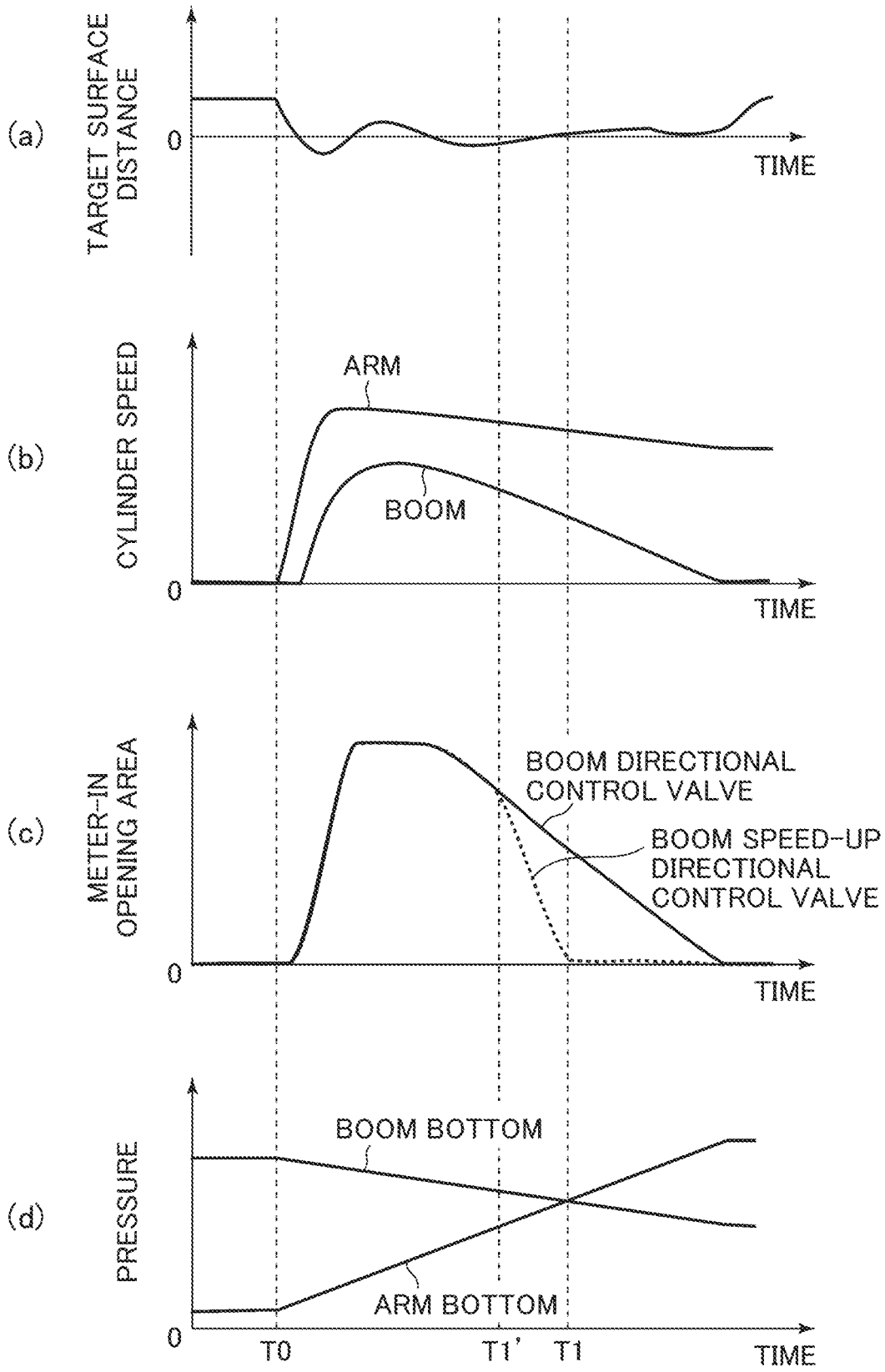
FIG. 7B is a characteristic diagram showing an example of time-series behavior of the construction machine in the first embodiment of the construction machine according to the present invention.

Next, behavior of the first embodiment of the construction machine according to the present invention will be described with reference to the drawings. FIG. 7A is a characteristic diagram showing an example of time-series behavior of a conventional construction machine. FIG. 7B is a characteristic diagram showing an example of time-series actions of the construction machine in the first embodiment of the construction machine according to the present invention.

FIG. 7A shows an example of a case in which the boom directional control valve 23 and the boom speed-up directional control valve 24 are driven by the same pilot pressure, while FIG. 7B shows an example of a case in which the boom directional control valve 23 and the boom speed-up directional control valve 24 are driven by individual pilot pressures.

In FIGS. 7A and 7B, a horizontal axis indicates time, and a vertical axis indicates the target surface distance in (a), a cylinder speed in (b), a meter-in opening area in (c), and the arm bottom pressure and the cylinder bottom pressure in (d). It is noted that the target surface distance means the distance from the work implement 15 to the construction target surface. Furthermore, time T1 indicates time at which the arm bottom pressure of the arm cylinder 6 becomes higher than the boom bottom pressure of the boom cylinder 5.

In FIG. 7A, when the excavation starts at time T0, then the hydraulic fluid is supplied to the arm cylinder 6, and an arm cylinder speed increases as shown in (b). When the target surface distance becomes 0, then the meter-in opening area of the boom directional control valve 23 increases as shown in (c), the hydraulic fluid is supplied to the boom cylinder 5, and a boom cylinder speed increases. It is noted that description will be given herein on assumption that opening characteristics of the boom directional control valve 23 and the boom speed-up directional control valve 24 for the pilot pressure are identical for simplification of the drawings. An increase of the boom cylinder speed enables the work implement 15 to move along the construction target surface to keep the target surface distance at around 0 as shown in (a). At this time, the arm bottom pressure increases by the excavation reaction force and the boom bottom pressure decreases conversely as shown in (d).

When the arm bottom pressure becomes higher than the boom bottom pressure at time T1, the diversion amount of the hydraulic fluid passing through the boom speed-up directional control valve 24 increases; thus, the boom cylinder speed increases and the arm cylinder speed decreases as shown in (b). As a result, the target surface distance increases. In other words, a problem occurs that the work implement 15 moves away from the construction target surface.

Next, the behavior in the present embodiment will be described with reference to FIG. 7B. In FIG. 7B, the construction machine behaves similarly to that in a case of FIG. 7A before time T1'. In the present embodiment, when the arm bottom pressure becomes closer to the boom bottom pressure from time T1' to time T1, the meter-in opening area of the boom speed-up directional control valve 24 decreases as shown in (c); thus, the diversion amount of the hydraulic fluid passing through the boom speed-up directional control valve 24 does not increase. This can keep the balance between the boom cylinder speed and the arm cylinder speed as shown in (b).

This is because the control exercised by the boom speed-up control section 150 limits the pilot pressure acting on the boom speed-up directional control valve 24 in response to the arm bottom pressure. As a result, the target surface distance is kept around 0 as shown in (a).

According to the first embodiment of the construction machine of the present invention described above, the second directional control valve and the first speed-up directional control valve are configured to be able to divert the hydraulic fluid and the driving amount of the first speed-up directional control valve is controlled in response to the excavation load. Therefore, even when the excavation load increases, it is possible to suppress the diversion and prevent the deviation from the target locus while avoiding the relief-caused loss. As a consequence, it is possible to ensure predetermined finishing precision.

Second Embodiment

Figure 8A:
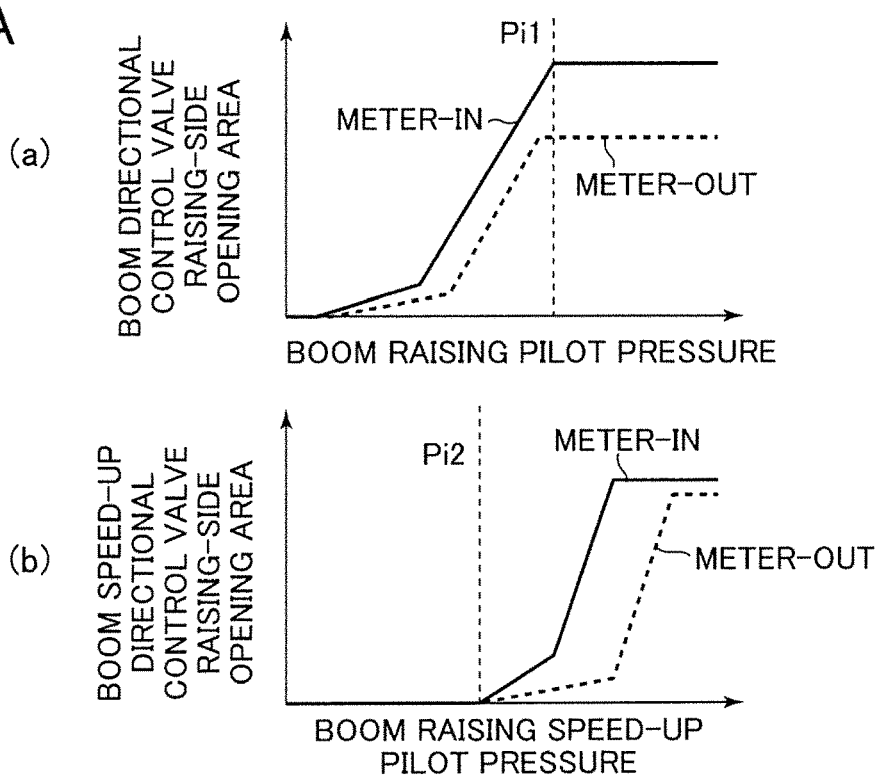
FIG. 8A is an opening characteristic diagram showing an example of opening characteristics of a boom directional control valve and a boom speed-up directional control valve in the conventional construction machine.
Figure 8B:
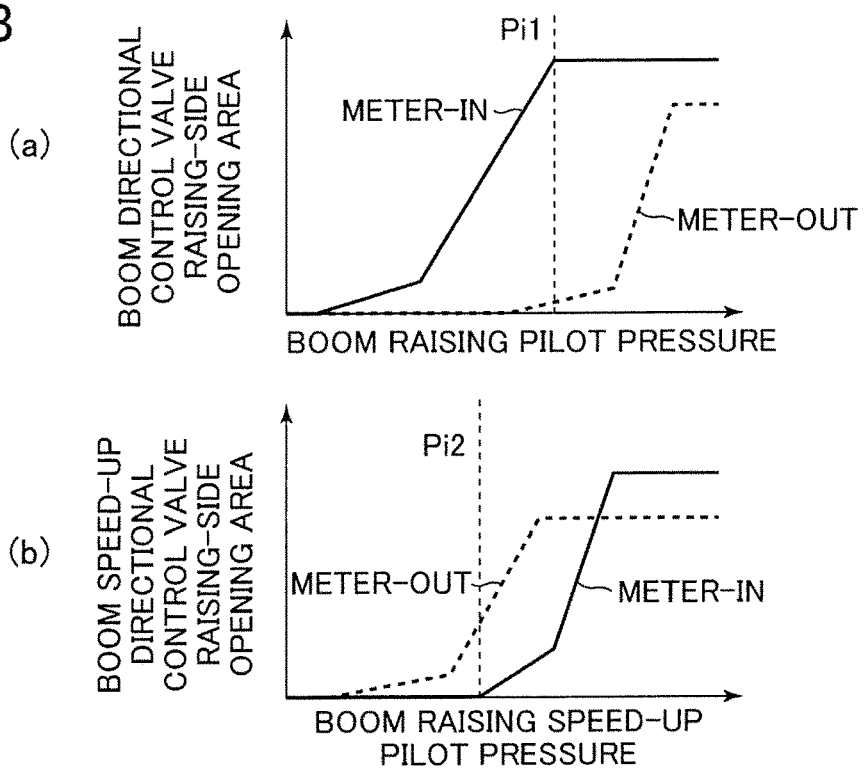
FIG. 8B is an opening characteristic diagram showing an example of opening characteristics of a boom directional control valve and a boom speed-up directional control valve that configure a second embodiment of the construction machine according to the present invention.

A second embodiment of the construction machine according to the present invention will be described hereinafter with reference to the drawings. FIG. 8A is an opening characteristic diagram showing an example of opening characteristics of the boom directional control valve and the boom speed-up directional control valve in the conventional construction machine. FIG. 8B is an opening characteristic diagram showing an example of opening characteristics of the boom directional control valve and the boom speed-up directional control valve that configure the second embodiment of the construction machine according to the present invention.

While a configuration of a hydraulic drive system in the second embodiment of the construction machine according to the present invention is generally the same as that in the first embodiment, the second embodiment differs from the first embodiment in that opening area characteristics for the pilot pressures are changed from ordinary characteristics according to the conventional technique.

In FIG. 8A, (a) shows a boom raising-side opening area of the boom directional control valve 23 for the boom raising pilot pressure in the conventional construction machine, and (b) shows a boom raising-side opening area of the boom speed-up directional control valve 24 for the boom raising speed-up pilot pressure in the conventional construction machine. Likewise, in FIG. 8B, (a) shows a boom raising-side opening area of the boom directional control valve 23 for the boom raising pilot pressure in the second embodiment of the present invention, and (b) shows a boom raising-side opening area of the boom speed-up directional control valve 24 for the boom raising speed-up pilot pressure in the second embodiment of the present invention. In each drawing, a solid line indicates meter-in opening area characteristics and a broken line indicates meter-out opening area characteristics.

In the conventional technique, as shown in FIG. 8A, the boom directional control valve 23 and the boom speed-up directional control valve 24 are generally set such that meter-in opening areas and meter-out opening areas open simultaneously for the respective boom raising pilot pressures.

In the present embodiment, by contrast, the boom directional control valve 23 is set such that the meter-in opening area starts to increase earlier than the meter-out opening area for the boom raising pilot pressure as shown in (a) of FIG. 8B. In addition, the boom speed-up directional control valve 24 is set such that the meter-out opening area starts to increase earlier than the meter-in opening area for the boom raising speed-up pilot pressure as shown in (b) of FIG. 8B. Furthermore, when the meter-out opening area of the boom directional control valve 23 is compared with the meter-out opening area of the boom speed-up directional control valve 24 on assumption that the same pilot pressure acts on the boom directional control valve 23 and the boom speed-up directional control valve 24, the boom directional control valve 23 and the boom speed-up directional control valve 24 are set such that the meter-out opening area of the boom speed-up directional control valve 24 starts to increase earlier than the meter-out opening area of the boom directional control valve 23. In other words, the pilot pressure at which the boom speed-up directional control valve 24 starts to open is set to a lower value than the pilot pressure at which the boom directional control valve 23 starts to open.

Setting the opening area characteristics in this way makes it possible to adjust the meter-out opening areas for the boom only by the boom speed-up directional control valve 24 in a region in which the pilot pressure is low, that is, in a region in which the boom speed is low.

For example, in the present embodiment, comparing a case in which the boom raising pilot pressure is applied as Pi1 indicated by a broken line shown in (a) of FIG. 8B and the boom raising speed-up pilot pressure is applied as Pi2 indicated by a broken line shown in (b) of FIG. 8B with a case in which the boom raising pilot pressure is applied as Pi1 indicated by the broken line shown in (a) of FIG. 8A and the boom raising speed-up pilot pressure is applied as Pi2 indicated by the broken line shown in (b) of FIG. 8A, a total meter-out opening area in the present embodiment is smaller than that in the conventional technique.

Owing to this, in the present embodiment, when the boom raising speed-up pilot pressure is limited in a case, for example, in which the excavation load increases, the meter-out opening area of the boom speed-up directional control valve 24 can be reduced simultaneously with closing of the meter-in opening thereof; thus, it is possible to increase a boom rod pressure. This can prevent a reduction of the load pressure of the boom cylinder 5 in an extension direction thereof due to the excavation reaction force and, therefore, keep the speed balance between the arm cylinder 6 and the boom cylinder 5. As a consequence, it is possible to attain predetermined finishing precision.

Figure 9A:
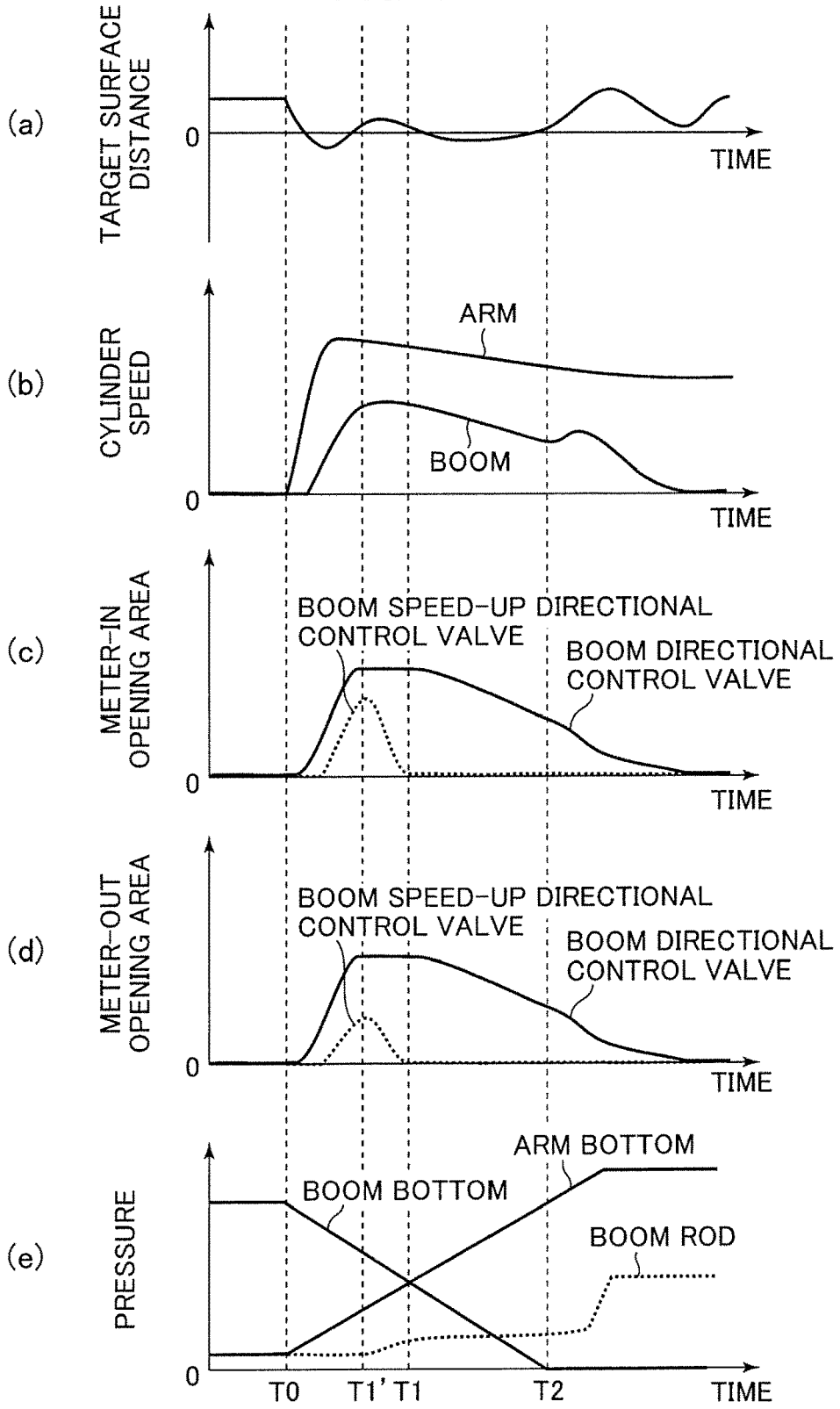
FIG. 9A is a characteristic diagram showing an example of time-series behavior of the construction machine to which directional control valves having conventional opening area characteristics are applied in the second embodiment of the construction machine according to the present invention.
Figure 9B:
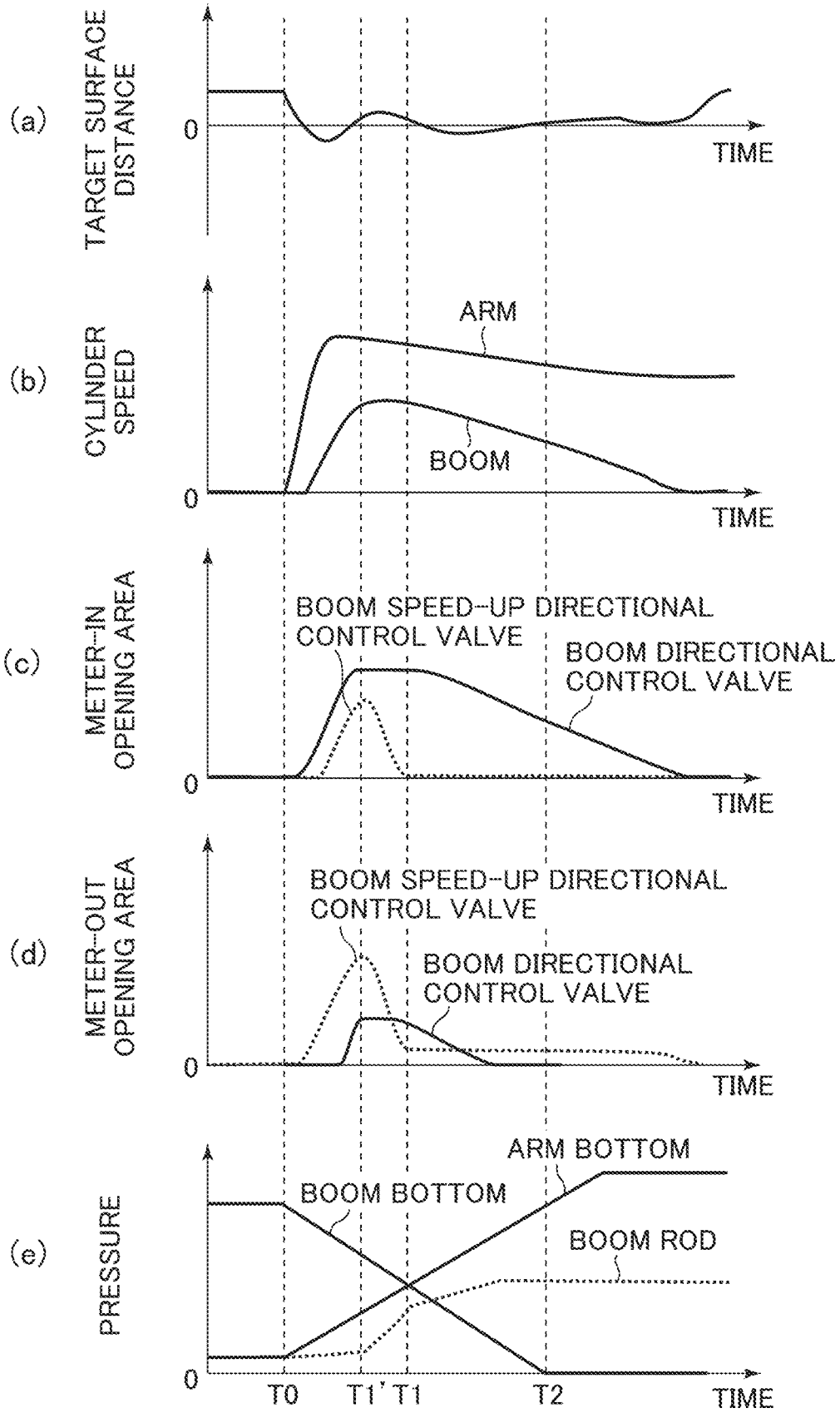
FIG. 9B is a characteristic diagram showing an example of time-series behavior of the construction machine in the second embodiment of the construction machine according to the present invention.

Next, behavior of the second embodiment of the construction machine according to the present invention will be described with reference to the drawings. FIG. 9A is a characteristic diagram showing an example of time-series behavior of the construction machine to which directional control valves having conventional opening area characteristics are applied in the second embodiment of the construction machine according to the present invention. FIG. 9B is a characteristic diagram showing an example of time-series behavior of the construction machine in the second embodiment of the construction machine according to the present invention.

In FIGS. 9A and 9B, a horizontal axis indicates time, and a vertical axis indicates the target surface distance in (a), the cylinder speed in (b), the meter-in opening area in (c), the meter-out opening area in (d), and the arm bottom pressure and the cylinder bottom pressure in (e). It is noted that the target surface distance means the distance from the work implement 15 to the construction target surface. Furthermore, time T1 indicates time at which the arm bottom pressure of the arm cylinder 6 becomes higher than the boom bottom pressure of the boom cylinder 5, and time T2 indicates time at which the boom bottom pressure of the boom cylinder 5 becomes approximately 0.

In FIG. 9A, when the excavation starts at time T0, then the hydraulic fluid is supplied to the arm cylinder 6, and the arm cylinder speed increases as shown in (b). When the target surface distance becomes 0, then the meter-in openings of the boom directional control valve 23 and the boom speed-up directional control valve 24 sequentially open as shown in (c), the hydraulic fluid is supplied to the boom cylinder 5, and the boom cylinder speed increases. At the same time, the meter-out openings of the boom directional control valve 23 and the boom speed-up directional control valve 24 sequentially open as shown in (d), and a rod-side pressure of the boom cylinder 5 (hereinafter, referred to as boom rod pressure) in response to the opening areas and the boom cylinder speed is generated as shown in (e). An increase of the boom cylinder speed enables the work implement 15 to move along the construction target surface to keep the target surface distance at around 0 as shown in (a). At this time, the arm bottom pressure increases by the excavation reaction force and the boom bottom pressure decreases conversely.

When the arm bottom pressure becomes closer to the boom bottom pressure from time T1' to time T1, the pilot pressure acting on the boom speed-up directional control valve 24 is limited as described above. As a result, the meter-in opening area of the boom speed-up directional control valve 24 decreases as shown in (c); thus, the diversion amount of the hydraulic fluid passing through the boom speed-up directional control valve 24 does not increase, and the balance is kept between the boom cylinder speed and the arm cylinder speed as shown in (b). At this time, the meter-out opening area of the boom speed-up directional control valve 24 also decreases as shown in (d). However, the meter-out opening area of the boom directional control valve 23 is relatively large and the total meter-out opening area, therefore, becomes relatively large; thus, an increment of the boom rod pressure shown in (e) is small.

At time T2, at which the boom bottom pressure further decreases by the excavation reaction force and reaches approximately 0 as shown in (e), the boom cylinder 5 starts to extend at a speed equal to or higher than a flow rate of the supplied hydraulic fluid. As a result, the target surface distance shown in (a) increases. In other words, a problem occurs that the work implement 15 moves away from the construction target surface.

Next, the behavior in the present embodiment will be described with reference to FIG. 9B. In FIG. 9B, the construction machine behaves similarly to that in a case of FIG. 9A before time T1'. In the present embodiment, the meter-in opening areas shown in (c) behaves similarly to that in the case of FIG. 9A from time T1' to time T1, too. On the other hand, the meter-out opening area of the boom speed-up directional control valve 24 greatly decreases as shown in (d). Since the construction machine is configured such that the meter-out opening area of the boom speed-up directional control valve 24 is relatively large to the meter-out opening area of the boom directional control valve 23, the total meter-out opening area of the two valves becomes relatively small. The boom rod pressure thereby increases relatively greatly as shown in (e).

At time T2, the boom bottom pressure further decreases by the excavation reaction force and reaches approximately 0. However, the boom rod pressure is relatively high as shown in (e); thus, it is possible to prevent the boom cylinder 5 from extending at the speed equal to or higher than the flow rate of the supplied hydraulic fluid as shown in (b). As a result, the target surface distance is kept around 0 as shown in (a).

The second embodiment of the construction machine according to the present invention described above can attain similar effects to those of the first embodiment.

It is noted that the present invention is not limited to the embodiments described above but encompasses various modifications. For example, the present invention has been described while the boom cylinder 5 and the arm cylinder 6 are taken as an example in the above embodiments; however, the present invention is not limited to this.

Furthermore, the above embodiments have been described in detail for facilitating understanding the present invention, and the present invention is not always limited to the construction machine having all the configurations described above.

REFERENCE SIGNS LIST

5: Boom cylinder (first hydraulic actuator)
6: Arm cylinder (second hydraulic actuator)
5*b*: Boom cylinder bottom-chamber-side pressure sensor
6*b*: Arm cylinder bottom-chamber-side pressure sensor (excavation load sensor)
15: Work implement
21: First hydraulic pump
22: Second hydraulic pump
23: Boom directional control valve (first directional control valve)
24: Boom speed-up directional control valve (first speed-up directional control valve)
25: Arm directional control valve (second directional control valve)
32: Mode setting switch
100: Main controller
130: Target surface distance acquisition section
150: Boom speed-up control section
200: Information controller
L1: First pump line
L2: Second pump line

The invention claimed is:

1. A construction machine comprising:
a first hydraulic actuator;
a second hydraulic actuator;
a work implement driven by the first hydraulic actuator and the second hydraulic actuator;
a first hydraulic pump;
a second hydraulic pump;
a first directional control valve provided in a first pump line that is a delivery hydraulic line of the first hydraulic pump and controlling a flow rate and a direction of a hydraulic fluid supplied to the first hydraulic actuator;
a first speed-up directional control valve provided in a second pump line that is a delivery hydraulic line of the second hydraulic pump and controlling a flow rate and a direction of a hydraulic fluid supplied to the first hydraulic actuator; and
a second directional control valve provided in the second pump line that is the delivery hydraulic line of the second hydraulic pump and controlling a flow rate and a direction of a hydraulic fluid supplied to the second hydraulic actuator, wherein
the construction machine includes:
an excavation load sensor that detects an excavation load imposed on the work implement; and
a first speed-up control section that drives the first speed-up directional control valve, and
the first speed-up control section is configured to control a driving amount of the first speed-up directional control valve in response to the excavation load detected by the excavation load sensor.

2. The construction machine according to claim 1, wherein
the work implement includes a boom and an arm,
the first hydraulic actuator is a boom cylinder that drives the boom,
the second hydraulic actuator is an arm cylinder that drives the arm,
the excavation load sensor is an arm cylinder bottom-chamber-side pressure sensor that measures a pressure of a bottom-side hydraulic chamber of the arm cylinder, and
the first speed-up control section is configured to control the driving amount of the first speed-up directional control valve in response to the pressure of the bottom-side hydraulic chamber of the arm cylinder measured by the arm cylinder bottom-chamber-side pressure sensor.

3. The construction machine according to claim 1, wherein
the work implement includes a boom and an arm,
the first hydraulic actuator is a boom cylinder that drives the boom,
the second hydraulic actuator is an arm cylinder that drives the arm,
the excavation load sensor is an arm cylinder bottom-chamber-side pressure sensor that measures a pressure of a bottom-side hydraulic chamber of the arm cylinder and a boom cylinder bottom-chamber-side pressure sensor that measures a pressure of a bottom-side hydraulic chamber of the boom cylinder, and
the first speed-up control section is configured to control the driving amount of the first speed-up directional control valve on the basis of a deviation between the pressure of the bottom-side hydraulic chamber of the boom cylinder measured by the boom cylinder bottom-chamber-side pressure sensor and the pressure of the bottom-side hydraulic chamber of the arm cylinder measured by the arm cylinder bottom-chamber-side pressure sensor.

4. The construction machine according to claim 3, wherein
the first speed-up control section is configured to exercise control such that an opening area of the first speed-up directional control valve is made smaller as the deviation between the pressure of the bottom-side hydraulic chamber of the boom cylinder and the pressure of the bottom-side hydraulic chamber of the arm cylinder is smaller, and such that the opening area of the first speed-up directional control valve is made larger as the pressure of the bottom-side hydraulic chamber of the arm cylinder is higher.

5. The construction machine according to claim 1, further comprising
a target surface distance acquisition section that measures or computes a target surface distance that is a distance between a target surface subjected to work conducted by the work implement and the work implement, wherein the first speed-up control section is configured to exercise control such that the driving amount of the first speed-up directional control valve is corrected in response to the target surface distance.

6. The construction machine according to claim 1, wherein the first directional control valve and the first speed-up directional control valve are driven by a pilot hydraulic fluid generated by a pilot hydraulic fluid source, the first directional control valve and the first speed-up directional control valve each include a meter-out opening that communicates a discharge-side hydraulic chamber of the first hydraulic actuator with a hydraulic tank, and a value of the pilot pressure at which the meter-out opening of the first speed-up directional control valve starts to open is set lower than a value of the pilot pressure at which the meter-out opening of the first directional control valve starts to open.

* * * * *